US010544644B2

(12) United States Patent
Pounds, Jr.

(10) Patent No.: US 10,544,644 B2
(45) Date of Patent: Jan. 28, 2020

(54) APPARATUS WITH CROSSOVER ASSEMBLY TO CONTROL FLOW WITHIN A WELL

(71) Applicant: Halliburton Energy Services, Inc., Houston, TX (US)

(72) Inventor: Steve Robert Pounds, Jr., Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 16/060,822

(22) PCT Filed: Aug. 7, 2017

(86) PCT No.: PCT/US2017/045783

§ 371 (c)(1),
(2) Date: Jun. 8, 2018

(87) PCT Pub. No.: WO2019/032090

PCT Pub. Date: Feb. 14, 2019

(65) Prior Publication Data

US 2019/0264526 A1 Aug. 29, 2019

(51) Int. Cl.
*E21B 33/12* (2006.01)
*E21B 34/06* (2006.01)
(Continued)

(52) U.S. Cl.
CPC ..... *E21B 33/12* (2013.01); *E21B 34/06* (2013.01); *E21B 43/12* (2013.01); *E21B 43/14* (2013.01)

(58) Field of Classification Search
CPC ..... E21B 33/12; E21B 34/06; E21B 43/12
See application file for complete search history.

(56) References Cited

U.S. PATENT DOCUMENTS

2002/0088621 A1 7/2002 Hamilton et al.
2009/0095471 A1* 4/2009 Guignard ..... E21B 34/14 166/278

(Continued)

FOREIGN PATENT DOCUMENTS

WO 2013159007 A1 10/2013
WO 2014124533 A1 8/2014

OTHER PUBLICATIONS

International Search Report and the Written Opinion for International Application No. PCT/US2017/045783 dated Apr. 12, 2018, 15 pages.

*Primary Examiner* — David J Bagnell
*Assistant Examiner* — Yanick A Akaragwe
(74) *Attorney, Agent, or Firm* — Chamberlain Hrdlicka

(57) ABSTRACT

An apparatus for controlling fluid flow in a well includes an inner tubular member with a flow path formed therethrough and an outer tubular member configured to be positionable about the inner tubular member to define an annulus between the outer tubular member and the inner tubular member. The apparatus further includes a crossover assembly coupled to the inner tubular member and the outer tubular member and configured to enable fluid flow between the flow path of the inner tubular member and an exterior of the outer tubular member, and a flow control device coupled to the crossover assembly and configured to control fluid flow through the crossover assembly.

13 Claims, 4 Drawing Sheets

(51) Int. Cl.
*E21B 43/12* (2006.01)
*E21B 43/14* (2006.01)

(56) References Cited

U.S. PATENT DOCUMENTS

| | | | |
|---|---|---|---|
| 2009/0294128 | A1 | 12/2009 | Dale et al. |
| 2010/0294495 | A1 | 11/2010 | Clarkson et al. |
| 2011/0162832 | A1 | 7/2011 | Reid |
| 2016/0186544 | A1 | 6/2016 | Greci et al. |

* cited by examiner

APPARATUS WITH CROSSOVER ASSEMBLY TO CONTROL FLOW WITHIN A WELL

BACKGROUND

This section is intended to provide relevant contextual information to facilitate a better understanding of the various aspects of the described embodiments. Accordingly, it should be understood that these statements are to be read in this light and not as admissions of prior art.

The present disclosure generally relates to oil and gas exploration and production, and more particularly to an apparatus or system to control flow within a well.

In a hydrocarbon production well, it is many times beneficial to be able to regulate or control the flow of fluids from an earth formation into a well or wellbore, from the wellbore into the formation, and within the wellbore. A variety of purposes may be served by such regulation, including prevention of water or gas coning, minimizing sand production, minimizing water and/or gas production, maximizing oil production, balancing production among zones, transmitting signals, in addition to other uses.

Therefore, it will be appreciated that advancements in the art of controlling fluid flow in a well would be desirable in the circumstances mentioned above, and such advancements would also be beneficial in a wide variety of other circumstances.

BRIEF DESCRIPTION OF THE DRAWINGS

Illustrative embodiments of the present disclosure are described in detail below with reference to the attached drawing figures, which are incorporated by reference herein and wherein.

Figure 1:
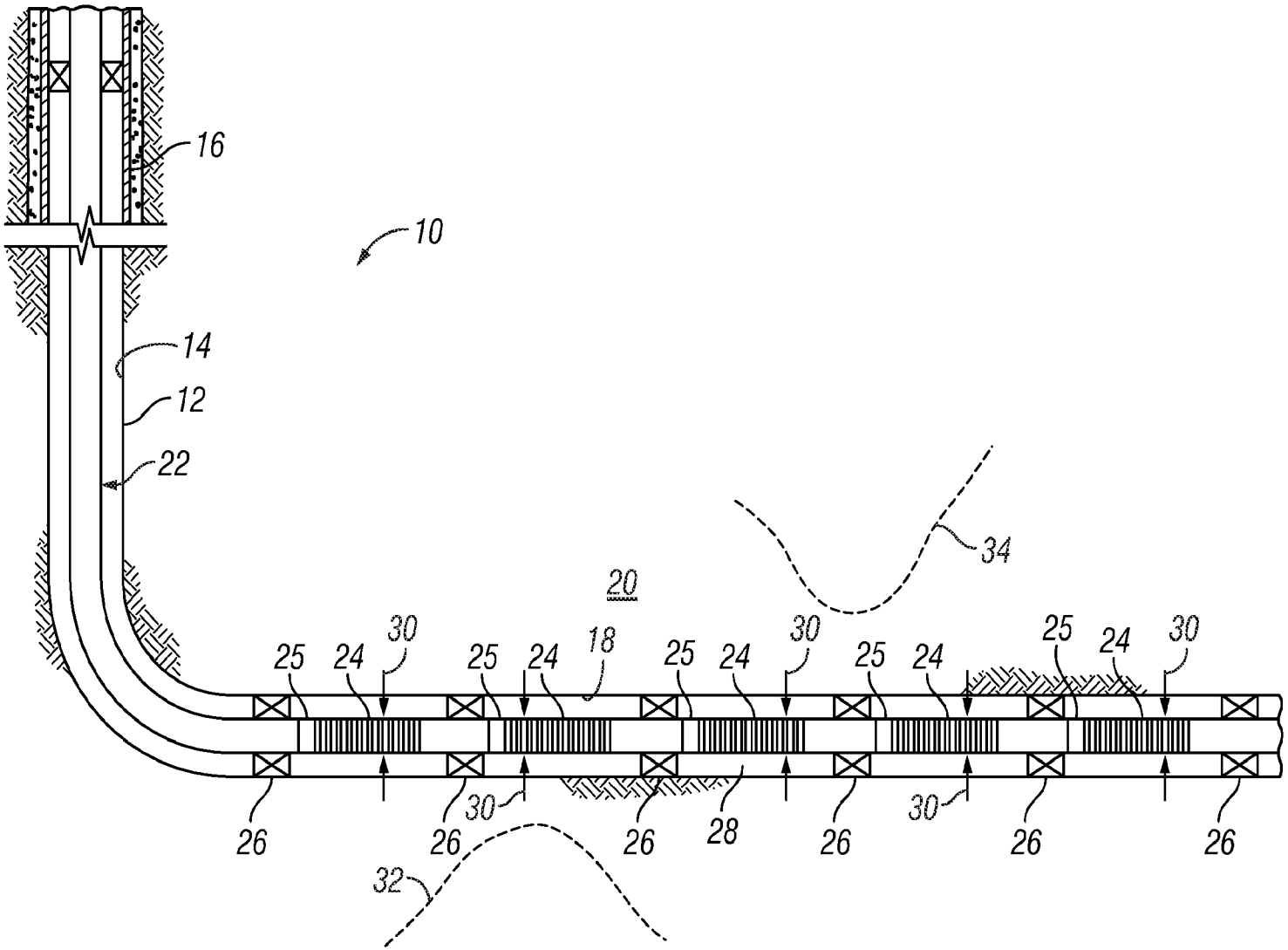
FIG. 1 shows schematic view of a well system in accordance with one or more embodiments of the present disclosure.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

Oil and gas hydrocarbons are naturally occurring in some subterranean formations. A subterranean formation containing oil or gas may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

The present disclosure relates generally to production, injection, and/or completion systems that allow fluid flow while providing zonal isolation to create one or more distinct production zones or injection zones within the well. Some of the zones may be actively producing formation fluids, while others may be non-productive zones and others may be injection zones. The establishment of zones provides the ability to shut off some zones, thereby preventing production from these zones. Creating zones also allows for a smooth production profile when each zone is allowed to contribute. The created zones, with the use of the present disclosure, may be configured such that simultaneous injection and production may take place within the well.

Turning now to the present figures, FIG. 1 shows a well system 10 in accordance with one or more embodiments. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 may be multiple well screens 24, flow control devices 25, and isolation devices, such as packers 26. The packers 26 isolate and seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a flow control device 25 are interconnected in the tubular string 22. The well screen 24 filters the fluids 30 flowing into the tubular string 22 from the annulus 28. The flow control device 25 variably restricts flow of the fluids 30 into the tubular string 22. The flow may be variably restricted by mechanical manipulation such as the closing of a port, or based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18, as a wellbore section may be oriented in any direction, and may be cased or uncased, without departing from the scope of the present disclosure. It is not necessary for fluids 30 to be only produced from the formation 20 since, in other examples, fluids could be injected into a formation, fluids could be both injected into and produced from a formation, etc. Further, it is not necessary for one each of the well screen 24 and flow control device 25 to be positioned between each adjacent pair of the packers 26. It is not necessary for a single flow control device 25 to be used in conjunction with a single well screen 24. Any number, arrangement and/or combination of these components may be used.

It is not necessary for any flow control device 25 to be used with a well screen 24. For example, in injection operations, the injected fluid could be flowed through a flow control device 25, without also flowing through a well screen 24. Further, it is not necessary for the well screens 24, flow control devices 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Whether a fluid is a desired or an undesired fluid depends on the purpose of the production or injection operation being conducted. For example, if it is desired to produce oil from a well, but not to produce water or gas, then oil is a desired fluid and water and gas are undesired fluids. Note that, at downhole temperatures and pressures, hydrocarbon gas can actually be completely or partially in liquid phase. Thus, it should be understood that the term "fluid" can include one or more fluids, such as oil and water, liquid water and steam, oil and gas, gas and water, oil, water and gas, etc., and that "gas" can include supercritical, liquid and/or gaseous phases.

Figure 2:
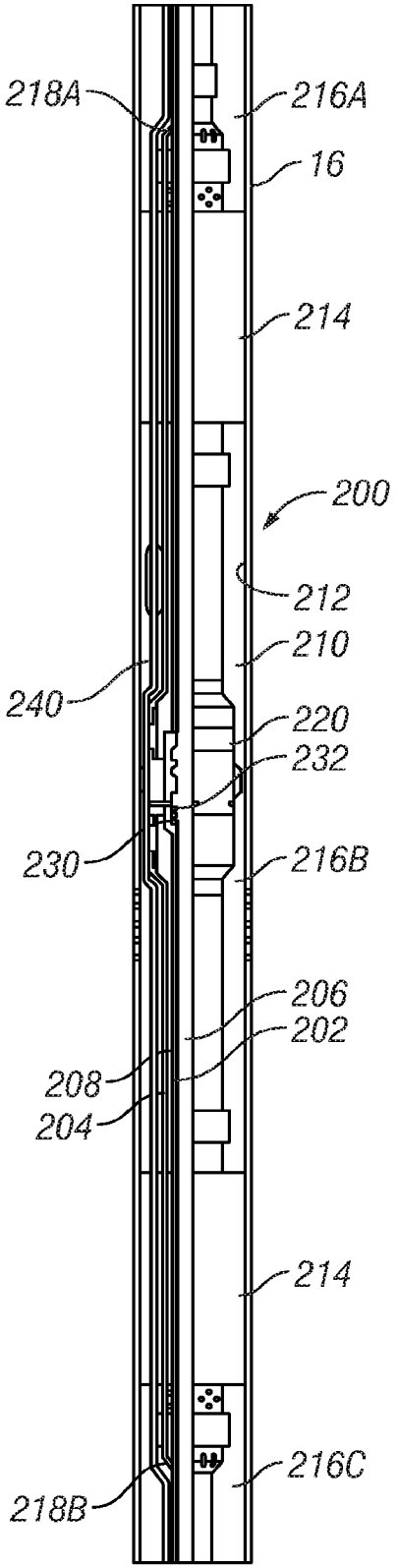
FIG. 2 shows a schematic view of an apparatus for controlling fluid flow in a well in accordance with one or more embodiments of the present disclosure.
Figure 3:
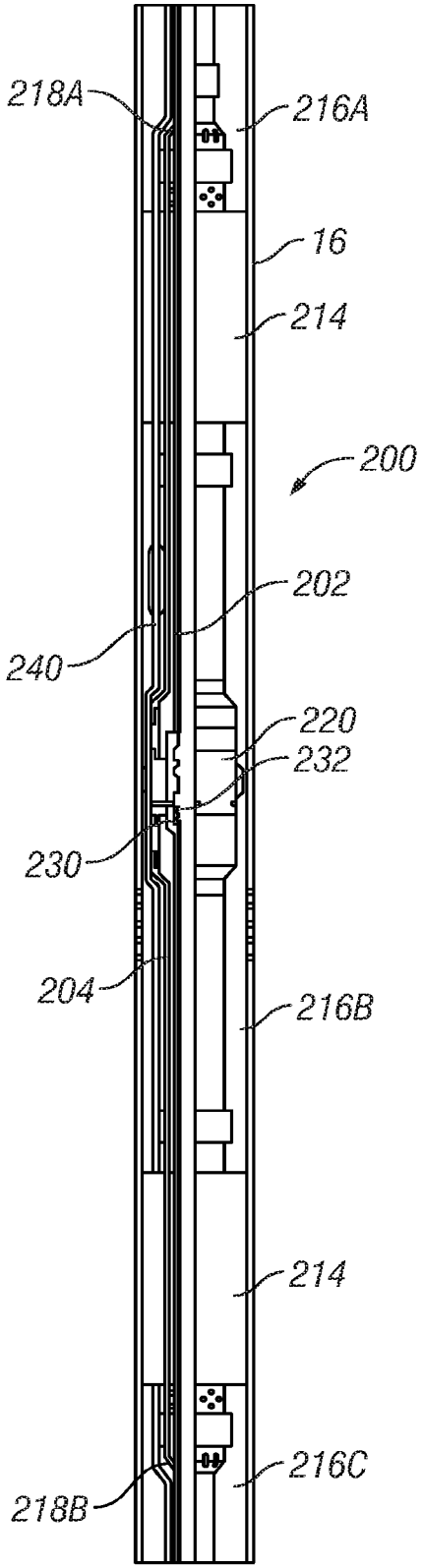
FIG. 3 shows a schematic view of an apparatus for controlling fluid flow in a well in accordance with one or more embodiments of the present disclosure.
Figure 4B:
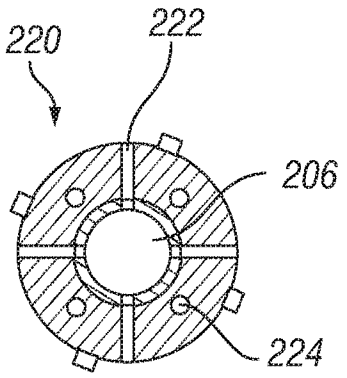
FIGS. 4A-4D show multiple sectional views of a crossover assembly of a fluid control apparatus in accordance with one or more embodiments of the present disclosure.
Figure 4D:
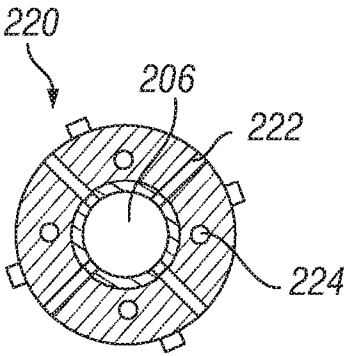
Figure 4A:
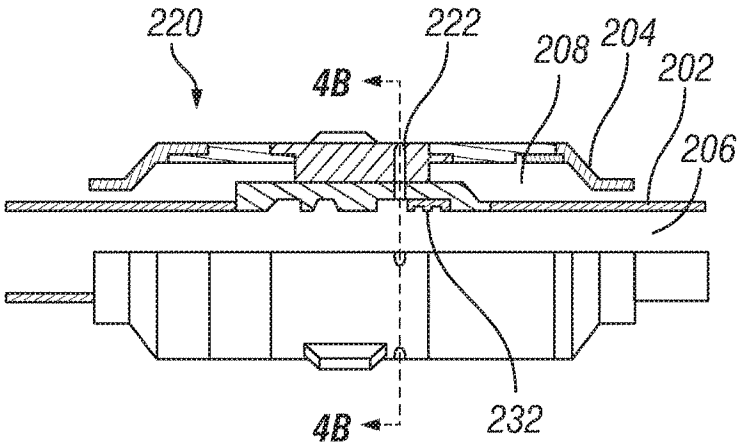
Figure 4C:
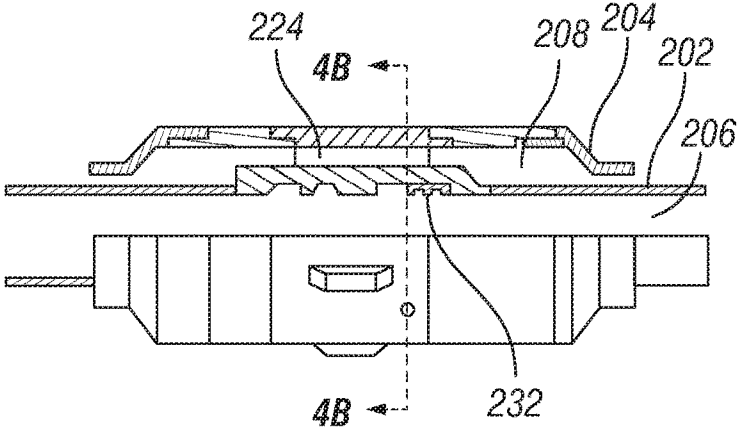

Referring now to FIGS. 2 and 3, multiple views of an apparatus 200 or system for controlling fluid flow in a well in accordance with one or more embodiments of the present disclosure are shown. In particular, FIG. 2 shows a schematic view of the apparatus 200 without fluid flowing through the apparatus 200, and FIG. 3 shows a schematic view of the apparatus 200 with fluid flowing through the apparatus 200. The apparatus 200, in this embodiment, is positioned within a well including casing 16.

The apparatus 200 includes an inner tubular member 202 and an outer tubular member 204 with the inner tubular member 202 positioned within the outer tubular member 204. The inner tubular member 202 defines a flow path 206 for fluid flow through the inner tubular member 202, and an annulus 208 is defined between the inner tubular member 202 and the outer tubular member 204 as another fluid flow path.

The apparatus 200 positioned within the well defines an annulus 210 between an exterior of the apparatus 200 and a wall 212 of the well. Further, the apparatus 200 includes one or more isolation devices or packers 214, in which the packers 214 isolate and seal off the annulus 210 formed radially between the apparatus 200 and the well wall 212. One or more of the packers 214 may be settable, inflatable, and/or swellable. If the packers 214 are settable, the packers 214 may be mechanically, pneumatically, hydraulically, and/or electrically activated or set. When the packers 214 are set within the well, multiple intervals or zones are formed within the annulus 210 between adjacent pairs of the packers 214. Accordingly, in FIGS. 2 and 3, the packers 214 may define multiple zones within the annulus 210, and in particular an upstream zone 216A, an intermediate zone 216B, and a downstream zone 216C.

The apparatus 200 includes one or more openings to enable fluid flow into and out of the apparatus 200, in particular into and out of the annulus 208 between the inner tubular member 202 and the outer tubular member 204. In FIGS. 2 and 3, an upstream opening 218A is formed in the outer tubular member 204 or between the inner tubular member 202 and the outer tubular member 204 to enable fluid flow between the upstream zone 216A and the annulus 208. Similarly, a downstream opening 218B is formed in the outer tubular member 204 or between the inner tubular member 202 and the outer tubular member 204 to enable fluid flow between the downstream zone 216C and the annulus 208.

As shown, the outer tubular member 204 extends from the upstream zone 216A, through the intermediate zone 216B, and to the downstream zone 216C. The outer tubular member 204, thus, defines the annulus 208 within the apparatus 200 between the outer tubular member 204 and the inner tubular member 202 with the annulus 208 extending from the upstream zone 216A through to the downstream zone 216C. The openings 218A and 218B enable fluid into and out of the annulus 208, in which the openings 218A and 218B may be formed within the outer tubular member 204 (as shown).

The upstream zone 216A and the downstream zone 216C are in fluid communication with each other through the annulus 208. This enables fluid from the upstream zone 216A to flow through the annulus 208 and into the downstream zone 216C, and vice-versa, as shown in FIG. 3. Further, as the packers 214 are included within the apparatus 200 and are set within the annulus 210 of the well, the upstream zone 216A and the downstream zone 216C are fluidly isolated from the intermediate zone 216B to prevent fluid flow between the zones 216A and 216C with the intermediate zone 216B.

The apparatus 200 further includes a crossover assembly 220 for managing fluid flow through the apparatus 200. For example, FIGS. 4A-4D provide multiple sectional views of the crossover assembly 220 in accordance with one or more embodiments of the present disclosure. The crossover assembly 220 enables fluid flow between the flow path 206 (e.g., the interior) of the inner tubular member 202 and the exterior of the outer tubular member 204 in the intermediate zone 216B. In particular, the crossover assembly 220 includes one or more passages 222 that extend between the interior of the inner tubular member 202 to the exterior of the outer tubular member 204, thereby enabling fluid flow between the flow path 206 and the intermediate zone 216B. The passages 222 extend and enable fluid flow across the annulus 208 without allowing mixture of the fluids from the passages 222 and the fluid from the annulus 208. The intermediate zone 216B is therefore in fluid communication with the flow path 206 of the inner tubular member 202 through the crossover assembly 220. This enables fluid from the intermediate zone 216B to flow through the crossover assembly 220 and into the flow path 206, and vice-versa, as shown in FIG. 3.

Further, the crossover assembly 220 includes one or more flow paths 224 that extend axially along the crossover assembly 220 and across the passages 222, in which the flow paths 224 enable fluid flow across the crossover assembly 220 and within the annulus 208. The flow paths 224, thus, enable fluid flow within the annulus 208 and across the crossover assembly 220. Lastly, as the flow paths 224 and the passages 222 are not in fluid communication and are fluidly isolated from each other, the crossover assembly 220 prevents fluid flow between the flow path 206 (e.g., the interior) of the inner tubular member 202 and the annulus 208.

Referring now collectively to FIGS. 2, 3, 4A, and 4C, the apparatus 200 includes a flow control device 230 to control fluid flow through the crossover assembly 220. In particular, the flow control device 230 controls fluid flow between the flow path 206 (e.g., the interior) of the inner tubular member 202 and the exterior of the outer tubular member 204 (e.g., the intermediate zone 216B). The flow control device 230 may be a valve, and more in particular may be a sliding sleeve 232. In this embodiment, the inner tubular member 202 includes a recess 234 with the sliding sleeve 232 positioned and movable within the recess 234. The sliding sleeve 232 is then movable with respect to the inner tubular member 202 to control fluid flow through the crossover assembly 220.

The flow control device 230 is movable between an open position and a closed position, such as movable with respect to the passages 222 of the crossover assembly 220. In the open position, as shown in FIGS. 2, 3, 4A, and 4C, the flow control device 230 enables fluid flow through the passages 222 of the crossover assembly 220 and between the flow path 206 of the inner tubular member 202 and the exterior of the outer tubular member 204. In the closed position, the flow control device 230 prevents fluid flow through the passages 222 of the crossover assembly 220 and between the flow path 206 of the inner tubular member 202 and an exterior of the outer tubular member 204. The flow control device 230 may be remotely-operated and/or manually-operated to move and control fluid flow through the crossover assembly. If remotely-operated, the flow control device 230 may be remotely controlled, such as from the surface of the well, to move the flow control device between the open and closed positions. The flow control device 230 may be operated mechanically, hydraulically, electrically, pneumatically, and/or a combination of the above to move the flow control device 230 between the open and closed positioned. In one embodiment, a control signal may be sent down a control line 240 coupled to the apparatus 200 to move the flow control device 230 between the open and closed positions. The control line 240 may additionally or alternatively be used to communicate with sensors or components downhole of the flow control device 230. If manually-operated, a tool or similar device may be run into the apparatus 200 to manually intervene and move the flow control device 230 between the open and closed positions.

In accordance with one or more embodiments of the present application, the apparatus 200 may be used to define multiple flow paths within the well and between different zones without crossing or mixing the different flow paths. As noted above, the apparatus 200 is able to fluidly isolate the upstream zone 216A and the downstream zone 216C from the intermediate zone 216B through the use of the packers 214. Further, the upstream zone 216A and the downstream zone 216C are in fluid communication with each other through the annulus 208 between the outer tubular member 204 and the inner tubular member 202. Furthermore, the intermediate zone 216B is in fluid communication with the flow path 206 of the inner tubular member 202 through the crossover assembly 220, such as when the flow control device 230 is in the open position and enabling fluid flow through the crossover assembly 220.

Accordingly, in one or more embodiments, fluid may be pumped (e.g., injected) into one or more zones while also produced from one or more other zones in a well using the apparatus 200. For example, in FIG. 3 showing fluid flow with the apparatus 200, fluid may be produced from the intermediate zone 216B while also being injected or pumped into the upstream zone 216A and the downstream zone 216C. As fluid is produced from the intermediate zone 216B, fluid may flow from the formation and through the perforations formed in the casing 16 and into the intermediate zone 216B of the annulus 210 between the packers 214. If the flow control device 230 is in the open position, fluid may continue to flow through the crossover assembly 220 and into the flow path 206 of the inner tubular member 202. The fluid may then continue to flow up through the flow path 206, through the apparatus 200, and through any other tubular members of the tubular string connected to the apparatus 200 and to the surface of the well.

At the same time (e.g., simultaneously), fluid may be injected or pumped into the upstream zone 216A, such as from the surface. For example, fluid may be pumped into the casing 16 at the surface, or fluid may be pumped into another tubing or flowline that leads into the upstream zone 216A. A packer (not shown) may be positioned above the uppermost packer 214 in FIG. 2 with fluid pumped through the tubing or flowline into the upstream zone 216A. Fluid may be pumped into the formation through the upstream zone 216A. Further, fluid may flow into the upstream opening 218A, through the annulus 208, and out the downstream opening 218B. This enables fluid to be pumped into the downstream zone 216C from the upstream zone 216A, in which fluid may be pumped into the formation through the downstream zone 216C. Alternatively, the apparatus 200 may be arranged such that fluid may be produced from the upstream zone 216A and the downstream zone 216C while also being injected or pumped into the intermediate zone 216B. Accordingly, the apparatus 200 may be used for injecting and producing from a well at the same time (e.g., simultaneously).

Figure 5:
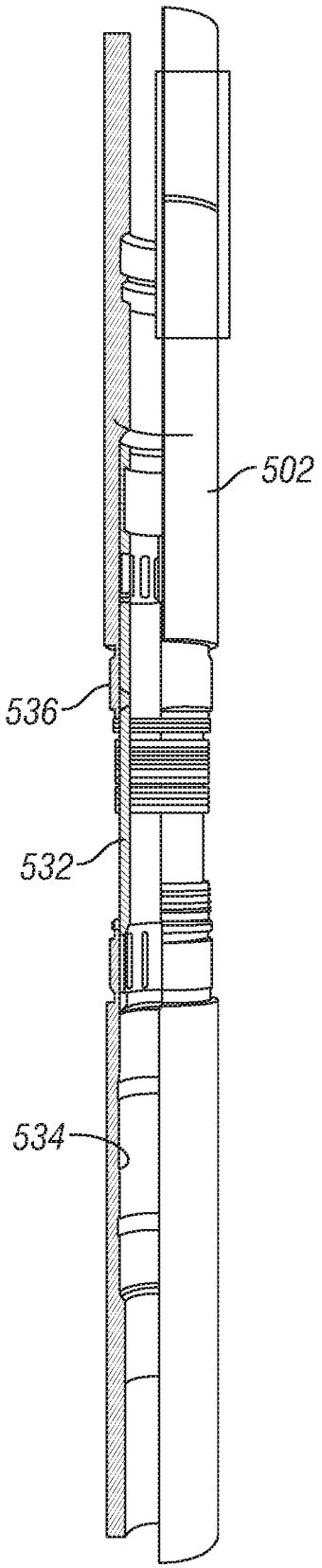
FIG. 5 shows a sectional view of an inner tubular member of a fluid control apparatus in accordance with one or more embodiments of the present disclosure.
Figure 6:
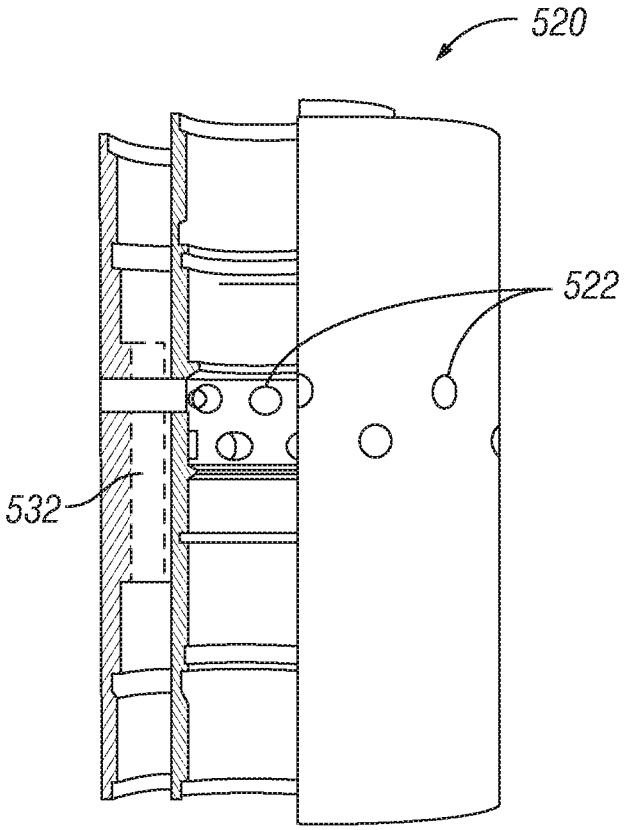
FIG. 6 shows a sectional view of a crossover assembly of a fluid control apparatus in accordance with one or more embodiments of the present disclosure.

Referring now to FIGS. 5 and 6, multiple views of components of an apparatus for controlling fluid flow in accordance with one or more embodiments of the present disclosure are shown. FIG. 5 shows a sectioned view of an inner tubular member 502 in accordance with the present disclosure, and FIG. 6 shows a sectioned view of a crossover assembly in accordance with the present disclosure.

As with the above, the inner tubular member 502 includes an inner recess 534 formed within an inner diameter of the inner tubular member 502. A sliding sleeve 532 is positioned and movable within the recess 534, such as movable with respect to the inner tubular member 502 to control fluid flow through the crossover assembly 520. The crossover assembly 520 is positioned about the inner tubular member 502. In particular, the inner tubular member 502 includes an outer recess 536 formed within an outer diameter of the inner tubular member 502, and the crossover assembly 520 may be positioned within the recess 536. The crossover assembly 520 also includes one or more ports 522 that enable fluid flow with the interior of the inner tubular member 502, and includes one or more flow paths 524 that enable fluid flow about the exterior of the inner tubular member 502. The apparatus in FIGS. 5 and 6 may then be operated similar to the apparatus 200 shown in FIGS. 2-4D.

In addition to the embodiments described above, many examples of specific combinations are within the scope of the disclosure, some of which are detailed below:

Embodiment 1. An apparatus for controlling fluid flow in a well, comprising:
- an inner tubular member comprising a flow path formed therethrough;
- an outer tubular member configured to be positionable about the inner tubular member to define an annulus between the outer tubular member and the inner tubular member;
- a crossover assembly coupled to the inner tubular member and the outer tubular member and configured to enable fluid flow between the flow path of the inner tubular member and an exterior of the outer tubular member; and
- a flow control device coupled to the crossover assembly and configured to control fluid flow through the crossover assembly.

Embodiment 2. The apparatus of Embodiment 1, further comprising:
- an upstream opening positioned on one side of the crossover assembly and configured to enable fluid flow into the annulus; and
- a downstream opening positioned on the other side of the crossover assembly configured to enable fluid flow into the annulus.

Embodiment 3. The apparatus of Embodiment 2, further comprising:
- an upstream isolation device positionable between the upstream opening and the crossover assembly and configured to prevent fluid flow across the upstream isolation device within the well; and
- a downstream isolation device positionable between the downstream opening and the crossover assembly and configured to prevent fluid flow across the downstream isolation device within the well.

Embodiment 4. The apparatus of Embodiment 3, wherein, when set within the well, the upstream isolation device and the downstream isolation device are configured to define an upstream zone, an intermediate zone, and a downstream zone between the apparatus and a wall of the well.

Embodiment 5. The apparatus of Embodiment 4, wherein:
- the upstream zone and the downstream zone are fluidly isolated from the intermediate zone;
- the upstream zone and the downstream zone are in fluid communication with each other through the annulus between the outer tubular member and the inner tubular member; and
- the intermediate zone is in fluid communication with the flow path of the inner tubular member through the crossover assembly.

Embodiment 6. The apparatus of Embodiment 3, wherein at least one of the upstream isolation device and the downstream isolation device comprises a packer.

Embodiment 7. The apparatus of Embodiment 1, wherein the flow control device comprises a valve.

Embodiment 8. The apparatus of Embodiment 7, wherein the valve comprises a sliding sleeve movable with respect to the inner tubular member to control fluid flow through the crossover assembly.

Embodiment 9. The apparatus of Embodiment 7, wherein:
- the valve is configured to move between an open position and a closed position;
- in the open position, the valve is configured to enable fluid flow through the crossover assembly and between the flow path of the inner tubular member and an exterior of the outer tubular member; and
- in the closed position, the valve is configured to prevent fluid flow through the crossover assembly and between the flow path of the inner tubular member and an exterior of the outer tubular member.

Embodiment 10. The apparatus of Embodiment 1, wherein the crossover assembly is configured to prevent fluid flow between the flow path of the inner tubular member and the annulus.

Embodiment 11. A method for controlling fluid flow into a well, comprising:
- positioning an apparatus within a well, the apparatus comprising:
  - an inner tubular member positioned within an outer tubular member to define an annulus therebetween; and
  - a crossover assembly configured to enable fluid flow between an interior of the inner tubular member and an exterior of the outer tubular member;
- setting an upstream isolation device and a downstream isolation device of the apparatus against a wall of the well to define an upstream zone, an intermediate zone, and a downstream zone between the apparatus and the wall with the upstream zone and the downstream zone in fluid communication with each other.

Embodiment 12. The method of Embodiment 11, further comprising:
- flowing fluid between the intermediate zone and the interior of the inner tubular member through the crossover assembly;
- flowing fluid between the upstream zone and the downstream zone through the annulus between the outer tubular member and the inner tubular member; and
- wherein the upstream zone and the downstream zone are fluidly isolated from the intermediate zone.

Embodiment 13. The method of Embodiment 12, wherein:
- the flowing fluid between the intermediate zone and the interior of the inner tubular member comprises pumping fluid through the interior of the inner tubular member and into the intermediate zone; and
- the flowing fluid between the upstream zone and the downstream zone comprises producing fluid from the upstream zone and the downstream zone at a surface of the well.

Embodiment 14. The method of Embodiment 12, wherein:
the flowing fluid between the intermediate zone and the interior of the inner tubular member comprises producing fluid from the intermediate zone; and
the flowing fluid between the upstream zone and the downstream zone comprises pumping fluid into the upstream zone and the downstream zone.

Embodiment 15. The method of Embodiment 14, wherein the pumping fluid and the producing fluid are performed simultaneously.

Embodiment 16. The method of Embodiment 11, further comprising moving a flow control device from a closed position to an open position to enable fluid flow between the intermediate zone and the interior of the inner tubular member through the crossover assembly.

Embodiment 17. An apparatus for controlling fluid flow into a well, comprising:
an inner tubular member comprising a flow path formed therethrough;
an outer tubular member configured to be positionable about the inner tubular member to define:
an annulus between the outer tubular member and the inner tubular member;
an upstream opening to enable fluid flow therethrough into the annulus; and
a downstream opening to enable fluid flow therethrough and into the annulus;
a crossover assembly configured to enable fluid flow between the flow path of the inner tubular member and an exterior of the outer tubular member;
an upstream isolation device configured to be positionable between the upstream opening and the crossover assembly; and
a downstream isolation device configured to be positionable between the downstream opening and the crossover assembly.

Embodiment 18. The apparatus of Embodiment 17, further comprising a flow control device configured to control fluid flow through the crossover assembly.

Embodiment 19. The apparatus of Embodiment 17, wherein, when set within the well, the upstream isolation device and the downstream isolation device are configured to define an upstream zone, an intermediate zone, and a downstream zone between the apparatus and a wall of the well.

Embodiment 20. The apparatus of Embodiment 19, wherein:
the upstream zone and the downstream zone are fluidly isolated from the intermediate zone;
the upstream zone and the downstream zone are in fluid communication with each other through the annulus between the outer tubular member and the inner tubular member; and
the intermediate zone is in fluid communication with the flow path of the inner tubular member through the crossover assembly.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. An apparatus for controlling fluid flow in a well, comprising:
an inner tubular member comprising a flow path formed therethrough;
an outer tubular member configured to be positionable about the inner tubular member to define an annulus between the outer tubular member and the inner tubular member;
a crossover assembly coupled to the inner tubular member and the outer tubular member and configured to enable fluid flow between the flow path of the inner tubular member and an exterior of the outer tubular member;
a flow control device coupled to the crossover assembly and configured to control fluid flow through the crossover assembly;
an upstream opening positioned on one side of the crossover assembly and configured to enable fluid flow into the annulus;

a downstream opening positioned on the other side of the crossover assembly configured to enable fluid flow into the annulus;

an upstream isolation device positionable between the upstream opening and the crossover assembly and configured to prevent fluid flow across the upstream isolation device within the well;

a downstream isolation device positionable between the downstream opening and the crossover assembly and configured to prevent fluid flow across the downstream isolation device within the well; and wherein, when the upstream isolation device and downstream isolation device are set within the well:

the upstream isolation device and the downstream isolation device are configured to define an upstream zone, an intermediate zone, and a downstream zone between the apparatus and a wall of the well;

the upstream zone and the downstream zone are fluidly isolated from the intermediate zone;

the upstream zone and the downstream zone are in fluid communication with each other through the annulus between the outer tubular member and the inner tubular member; and the intermediate zone is in fluid communication with the flow path of the inner tubular member through the crossover assembly.

2. The apparatus of claim 1, wherein at least one of the upstream isolation device and the downstream isolation device comprises a packer.

3. The apparatus of claim 1, wherein the flow control device comprises a valve.

4. The apparatus of claim 3, wherein the valve comprises a sliding sleeve movable with respect to the inner tubular member to control fluid flow through the crossover assembly.

5. The apparatus of claim 3, wherein:

the valve is configured to move between an open position and a closed position;

in the open position, the valve is configured to enable fluid flow through the crossover assembly and between the flow path of the inner tubular member and an exterior of the outer tubular member; and in the closed position, the valve is configured to prevent fluid flow through the crossover assembly and between the flow path of the inner tubular member and an exterior of the outer tubular member.

6. The apparatus of claim 1, wherein the crossover assembly is configured to prevent fluid flow between the flow path of the inner tubular member and the annulus.

7. A method for controlling fluid flow into a well, comprising:

positioning an apparatus within a well, the apparatus comprising:

an inner tubular member positioned within an outer tubular member to define an annulus therebetween; and a crossover assembly configured to enable fluid flow between an interior of the inner tubular member and an exterior of the outer tubular member;

setting an upstream isolation device and a downstream isolation device of the apparatus against a wall of the well to define an upstream zone, an intermediate zone, and a downstream zone between the apparatus and the wall with the upstream zone and the downstream zone in fluid communication with each other;

flowing fluid between the intermediate zone and the interior of the inner tubular member through the crossover assembly;

flowing fluid between the upstream zone and the downstream zone through the annulus between the outer tubular member and the inner tubular member; and wherein the upstream zone and the downstream zone are fluidly isolated from the intermediate zone.

8. The method of claim 7, wherein:

the flowing fluid between the intermediate zone and the interior of the inner tubular member comprises pumping fluid through the interior of the inner tubular member and into the intermediate zone; and the flowing fluid between the upstream zone and the downstream zone comprises producing fluid from the upstream zone and the downstream zone at a surface of the well.

9. The method of claim 7, wherein:

the flowing fluid between the intermediate zone and the interior of the inner tubular member comprises producing fluid from the intermediate zone; and the flowing fluid between the upstream zone and the downstream zone comprises pumping fluid into the upstream zone and the downstream zone.

10. The method of claim 9, wherein the pumping fluid and the producing fluid are performed simultaneously.

11. The method of claim 7, further comprising moving a flow control device from a closed position to an open position to enable fluid flow between the intermediate zone and the interior of the inner tubular member through the crossover assembly.

12. An apparatus for controlling fluid flow into a well, comprising:

an inner tubular member comprising a flow path formed therethrough; an outer tubular member configured to be positionable about the inner tubular member to define:

an annulus between the outer tubular member and the inner tubular member;

an upstream opening to enable fluid flow therethrough into the annulus; and a downstream opening to enable fluid flow therethrough and into the annulus;

a crossover assembly configured to enable fluid flow between the flow path of the inner tubular member and an exterior of the outer tubular member;

an upstream isolation device configured to be positionable between the upstream opening and the crossover assembly;

a downstream isolation device configured to be positionable between the downstream opening and the crossover assembly; and wherein, when the upstream isolation device and downstream isolation device are set within the well:

the upstream isolation device and the downstream isolation device are configured to define an upstream zone, an intermediate zone, and a downstream zone between the apparatus and a wall of the well;

the upstream zone and the downstream zone are fluidly isolated from the intermediate zone;

the upstream zone and the downstream zone are in fluid communication with each other through the annulus between the outer tubular member and the inner tubular member; and the intermediate zone is in fluid communication with the flow path of the inner tubular member through the crossover assembly.

13. The apparatus of claim 12, further comprising a flow control device configured to control fluid flow through the crossover assembly.

* * * * *